United States Patent [19]

Dumas

[11] Patent Number: 4,930,927

[45] Date of Patent: Jun. 5, 1990

[54] TAMPER-PROOF BINDER FOR PHOTOGRAPHS AND THE LIKE

[76] Inventor: Maurice R. Dumas, 620-A St., Waller, Tex. 77484

[21] Appl. No.: 310,695

[22] Filed: Feb. 15, 1989

[51] Int. Cl.[5] ..... B42F 13/14

[52] U.S. Cl. ..... 402/63; 402/52; 402/53; 402/48

[58] Field of Search ..... 402/48, 51, 52, 53, 402/63, 80 R

[56] References Cited

U.S. PATENT DOCUMENTS

| | | | |
|---|---|---|---|
| 635,409 | 10/1899 | Van Sickle | 402/52 |
| 741,710 | 10/1903 | Peugeot et al. | 402/53 |
| 1,726,810 | 9/1929 | Dawson | 402/53 |
| 1,745,911 | 2/1930 | Proudfit et al. | 402/53 |
| 1,836,200 | 12/1931 | Stein | 402/53 |
| 1,889,230 | 11/1932 | Unger | 402/53 |
| 2,560,110 | 7/1951 | Horn | 402/52 |
| 3,251,260 | 5/1966 | Serdechny | 402/52 X |
| 3,647,306 | 3/1972 | Chamberlin | 402/48 |
| 4,175,880 | 11/1979 | Müller | 402/53 X |
| 4,307,972 | 12/1981 | Errichiello | 402/52 X |
| 4,730,972 | 3/1988 | Sun | 402/62 X |
| 4,787,766 | 11/1988 | Lörsch | 402/79 |

*Primary Examiner*—Paul A. Bell

*Attorney, Agent, or Firm*—Neal J. Mosely

[57] ABSTRACT

A tamper-proof binder has a C-shaped rectangular spine into which a plurality of clear plastic envelopes carrying photographs or the like are secured. The envelopes are permanently sealed on three side edges and open only on one side which is secured in the spine to prevent the photos from being removed. The spine has an upper T-shaped longitudinal slot on the underside of the top wall and a lower longitudinal slot on the top side of the bottom wall and a counterbored hole extends through the bottom wall into the lower slot. The envelopes have holes spaced along the open side edge which receive a headed fastener for each hole. The heads of the fasteners are slidably received in the T-shaped slot of the spine and the shafts of the end fasteners are received in the lower slot at the bottom of the spine. A center fastener is a permanent two-part fastener with a head at both ends and the shaft portions engage each other to prevent the fastener from being pulled apart after being pressed together. The head of one piece of the two-piece fastener is slidably received in the T-shaped slot and the other headed piece is received in the hole at the bottom of the spine and the pieces are pressed together. Thus, a plurality of envelopes containing photographs and the like are sealed on all three exposed sides and are substantially "permanently" secured in the spine to prevent unauthorized removal of the photos or the envelopes.

19 Claims, 2 Drawing Sheets

TAMPER-PROOF BINDER FOR PHOTOGRAPHS AND THE LIKE

BACKGROUND OF THE INVENTION

1. Field of the Invention

This invention relates generally to binders, and more particularly to a tamper-proof binder with a plurality of clear plastic envelope sheets which receive photographs and the like and are sealed on three exposed sides and are substantially permanently secured in the binder to prevent unauthorized removal of the envelopes or contents thereof.

2. Brief Description of the Prior Art

Professional photographers and photography studios sometimes have a problem when sending "proof" photographs to their clients for approval. In some cases, after receiving the proofs, a client will take the proof photographs to another, less expensive printer and have finished copies made to avoid paying the studio costs. It would therefore be desirable to provide an attractive inexpensive "tamper-proof" binder in which photographers and photography studios may place their proof photographs and give to their client for approval and which would prevent unauthorized removal of the photographs and pages contained therein.

Tamper-proof binding systems are known in the art and there are several patents which disclose various binders having permanent fastener and/or spine constructions. The prior art constructions do not provide an envelope which will receive and display photographs and the like and which when secured in the spine of the binder will prevent unauthorized removal of the envelope and/or its contents.

Van Sickle, U.S. Pat. No. 635,409 and Horn, U.S. Pat. No. 2,560,110 disclose temporary binders utilizing threaded or serrated locking pins which lock or release upon rotation and allow the leaves or pages of the binder to be easily removed and replaced or additional pages inserted.

Dawson, U.S. Pat. No. 1,726,810 and Stein, U.S. Pat. No. 1,836,20 disclose loose-leaf binders utlizing telescoping posts and sliding latch bar mechanisms which allow pages to be easily and quickly removed or added.

Proudfit, U.S. Pat. No. 1,746,911 discloses a loose-leaf binder utilizing releasable plates having telescoping posts which allow pages to be removed or added.

Unger, U.S. Pat. No. 1,889,230 discloses a loose-leaf binder which allows pages to be easily and quickly removed or added and utlizes telescoping posts and has a sliding latch bar mechanism housed within a metal looped sheath and covered with fabric.

Serdechny, U.S. Pat. No. 3,251,260 discloses two-piece adjustable length fasteners having male and female shanks with barb-like mating surfaces which when pressed together are substantially permanently locked in the assembled state.

Muller, U.S. Pat. No. 4,175,880 discloses a pair of opposed binding strips each having stringing rods and sleeves extending therefrom in mutually alternating sequence and having a mutual spacing corresponding to the spacing of aligned holes in the materials to be bound. The rods have exterior detents and the sleeves have interior detents which are permanently engaged when the strips are pressed together.

Sun et al, U.S. Pat. No. 4,730,972 discloses a two part binding system which includes one or more bifurcated posts integrally extending from a clamping strip. The posts are inserted through the stack of material to be bound and a second clamping strip having one or more latching buttons is inserted over the posts. The buttons and posts have toothed surfaces which are engaged when pressed together. In normal usage the connection is permanent, however, the user may manually with a tweezer-like tool unlock the binder.

The present invention is distinguished over the prior art in general, and these patents in particular by a tamperproof binder having a C-shaped rectangular spine into which a plurality of clear plastic envelopes carrying photographs or the like are secured. The envelopes are permanently sealed on three side edges and open only on one side which is secured in the spine to prevent the photos from being removed. The spine has an upper T-shaped longitudinal slot on the underside of the top wall and a lower longitudinal slot on the top side of the bottom wall and a counterbored hole extends through the bottom wall into the lower slot. The envelopes have holes spaced along the open side edge which receive three headed fasteners. The heads of the fasteners are slidably received in the T-shaped slot of the spine and the shafts of the two end fasteners are received in the lower slot at the bottom of the spine. The center fastener is a permanent two-part fastener with a head at both ends and the shaft portions engage each other to prevent the fastener from being pulled apart after being pressed together. The head of one piece of the two-piece fastener is slidably received in the T-shaped slot and the other headed piece is received in the hole at the bottom of the spine and the pieces are pressed together. Thus, a plurality of envelopes containing photographs and the like are sealed on all three exposed sides and are substantiallY "permanently" secured in the spine to prevent unauthorized removal of the photos or the envelopes.

SUMMARY OF THE INVENTION

It is therefore an object of the present invention to provide a tamper-proof binder for photographs and the like which will prevent unauthorized removal of the contents.

It is another object of this invention to provide a tamper-proof binder for photographs and the like which is resuable and requires replacement of a single fastener for reuse.

Another object of this invention is to provide a tamper-proof binder for photographs and the like which is capable of receiving a plurality of envelopes.

Another object of this invention is to provide a tamper-proof binder for photographs and the like wherein the fasteners and the envelopes are secured within a spine and are for normal purposes substantially unremovable therefrom.

Another object of this invention is to provide a tamper-proof binder for photographs and the like which utilizes a minimum of components.

A further object of this invention is to provide an envelope for use in binders which is open only on one side edge with apertures along the open side edge and the open side edge is secured within the binder spine to substantially prevent removal of the envelope contents.

A still further object of this invention is to provide a tamper-proof binder for photographs and the like which is simple in constructon, economical to manufacture, and rugged and durable in use.

Other objects of the invention will become apparent from time to time throughout the specification and claims as hereinafter related.

The above noted objects and other objects of the invention are accomplished by a tamper-proof binder having a C-shaped rectangular spine into which a plurality of clear plastic envelopes carrying photographs or the like are secured. The envelopes are permanently sealed on three side edges and open only on one side which is secured in the spine to prevent the photos from being removed. The spine has an upper T-shaped longitudinal slot on the underside of the top wall and a lower longitudinal slot on the top side of the bottom wall an a counterbored hole extends through the bottom wall into the lower slot. The envelopes have holes spaced along the open side edge which receive three headed fasteners. The heads of the fasteners are slidably received in the T-shaped slot of the spine and the shafts of the two end fasteners are received in the lower slot at the bottom of the spine. The center fastener is a permanent two-part fastener with a head at both ends and the shaft portions engage each other to prevent the fastener from being pulled apart after being pressed together. The head of one piece of the two-piece fastener is slidably received in the T-shaped slot and the other headed piece is received in the hole at the bottom of the spine and the pieces are pressed together. Thus, a plurality of envelopes containing photographs and the like are sealed on all three exposed sides and are substantially "permanently" secured in the spine to prevent unauthorized removal of the photos or the envelopes.

DESCRIPTION OF THE PREFERRED EMBODIMENT

Figure 1:
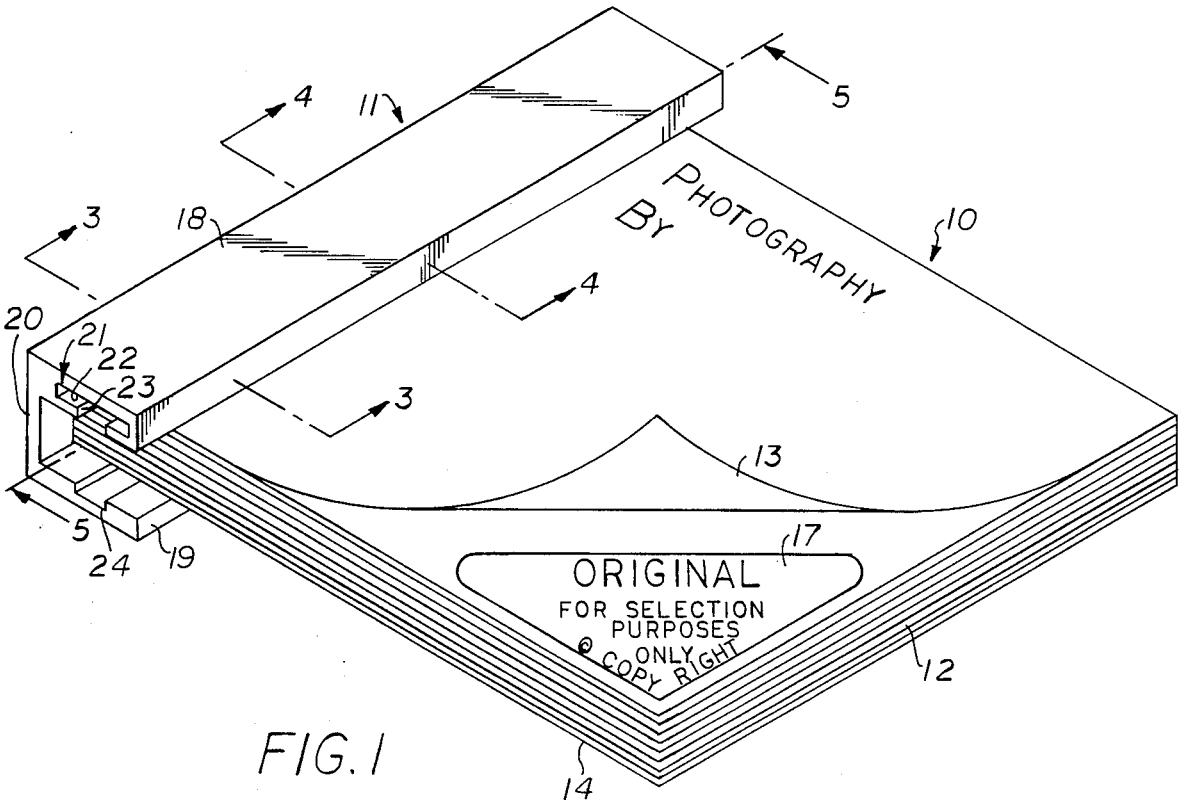
FIG. 1 is an isometric view of a preferred tamper-proof binder for and the like in accordance with the present invention.

Referring to the drawings by numerals of reference, there is shown in FIG. a preferred tamper-proof binder assembly 10. The binder assembly 10 comprises a rectangular spine member 11 formed of a channel having a generally C-shaped transverse cross into which there are secured a plurality of clear plastic sheet protectors or envelopes 12 for carrying photographs P or the like. A cover sheet 13 may be secured in the spine 11 atop the uppermost envelope 12 and a back sheet 14 secured underneath the bottom envelope. The preferred cover and back sheets 13 and 14 are formed of flexible opaque material such as vinyl plastic, leather, or cloth and either may also bear indicia such as the name and address of the photographer or photographic studio.

Figure 2:
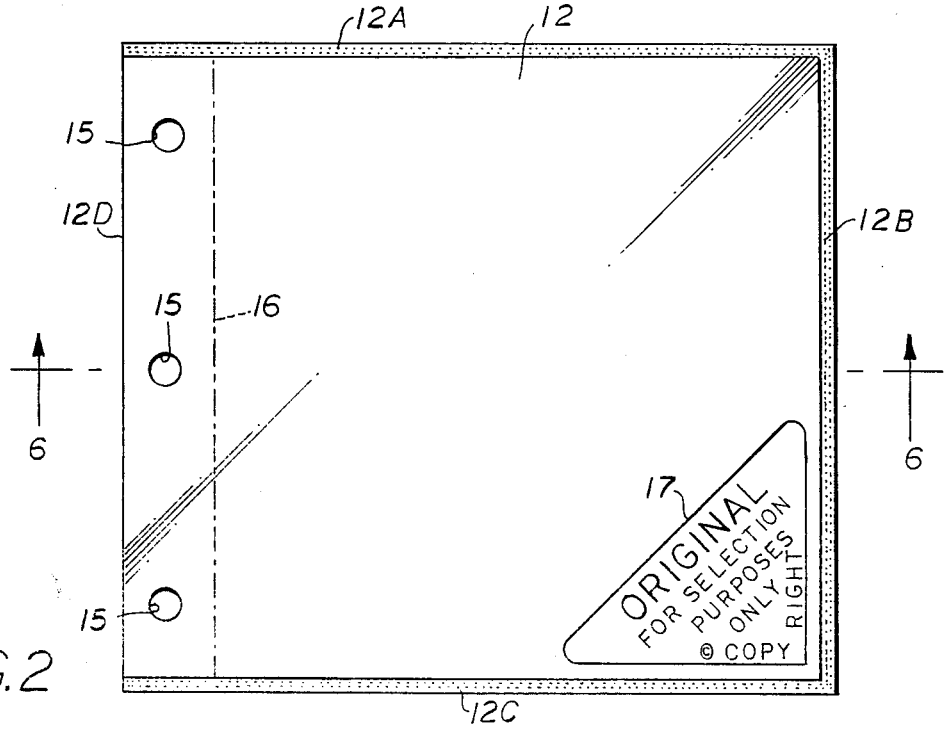
FIG. 2 is a top plan view of a preferred envelope for use in the binder assembly.
Figure 6:
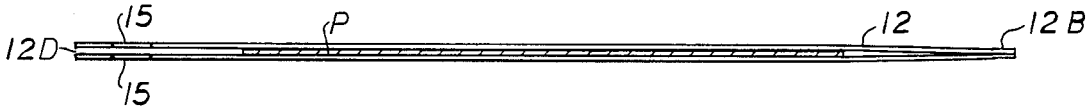
FIG. 6 is a cross section through an envelope used with the present taken along line 6—6 of FIG. 2.

Referring additionally to FIGS. 2 and 6, the preferred envelopes 12 are formed of two thin sheets of transparent plastic permanently sealed together along three side edges **12*a*, 12*b*, and 12*c*, by conventional means such as heat or sonic welding as indicated by the shaded area. Holes 15 are formed through both sheets in a spaced relation along the unsealed open side edge 12*d* of each envelope 12. Similarly, holes are provided in the cover and bottom sheets, if used. When assembled in the spine 11, the open side edge 12*d* will be overlapped a distance inward by the top lip of the spine as indicated by dotted line 16 to cover the holes 15**.

The envelopes 12 may also be provided with an opaque label or sticker 17 secured on the top sheet and may be applied at a location which would partially obscure a small portion of the photograph. The label or sticker 17 may also bear a copyright notice and/or indicia such as the name and address of the photographer or photographic studio. The indicia may also be printed on the envelopes. The sticker 17 or printing would discourage copying of the photograph through the transparent envelope.

Figure 3:
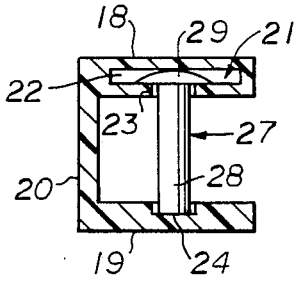
FIG. 3 is transverse cross section through the spine of the binder taken along line 3—3 of FIG. 1 and showing a non-permanent installed therein.
Figure 4:
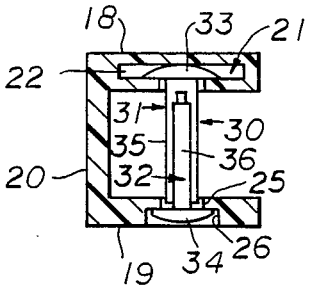
FIG. 4 is transverse cross section through the spine of the binder taken along line 4—4 of FIG. 1 and showing a permanent type fastener installed therein.
Figure 5:
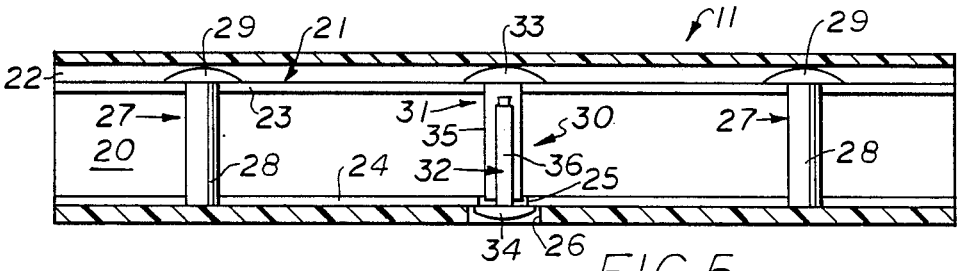
FIG. 5 is a longitudinal cross section through the spine of the binder taken along line 5—5 of FIG. 1 and showing a permanent fastener in the center with laterally spaced non-permanent fasteners installed therein.
Figure 7:
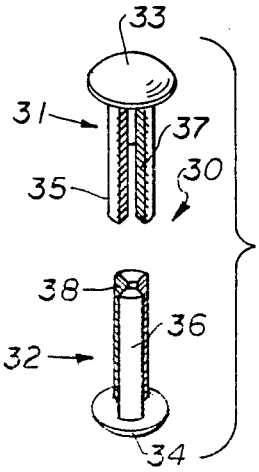
FIG. 7 is an exploded isometric view of a permanent fastener used in the present binder in the disengaged condition.

As previously stated and best seen in FIGS. 3, 4, and 5, the spine member 11 is formed of a rectangular, generally C-shaped channel. The channel has a top wall 18, a bottom wall 19, a back wall 20 and is open at both ends and along the front. A T-shaped slot 21 extends longitudinally through the top wall 18 with the wider portion 22 just below the outer surface and the narrower portion 23 cut through the interior surface of the top wall to form a pair of spaced, inwardly opposed longitudinal flanges. Another narrow slot 24 extends along the interior surface of the bottom wall 19 in opposed axial alignment with the narrow portion 23 of the T-shaped slot 21. A hole 25 is provided through the bottom wall 19 and is counterbored at 26.

When assembling the binder assembly 10, photographs or the like are placed inside the envelopes 12 and the envelopes are stacked with the holes 15 in vertical alignent. If a cover and/or back sheet are used, they are placed on the top and bottom of the stacked envelopes with their holes aligned with the envelope holes 15.

A non-permanent fastener 27 having a tubular or rod-like shank 28 and an enlarged head 29 is inserted through the outermost holes 15 with the head up. A two-piece permanent fastener 30 is installed through the center hole 15.

The two-piece permanent fastener 30 may be of the conventional type having a first member 31 adapted to receive and engage a second member 32. Both members 31 and 32 have enlarged heads 33 and 34 and elongated vertically slotted shanks 35 and 36 with a plurality of vertically spaced protuberences 37 and 38 therealong respectively. The vertically slotted shanks 35 and 36 and plurality of vertically spaced protuberences 37 and 38 cooperate with one another such that when the fastener members 31 and 32 are pressed together axially they become substantially permanently locked in the assembled state.

The shank 35 of the first member 31 is installed through the center hole 15 with its head 33 up. Now the stack of assembled envelopes 12 with the heads 29 and 33 of the fasteners 27 and 30 on the top side placed adjacent one of the open ends of the spine 11 with the fastener heads 29 and 33 aligned with the T-shaped slot 21. The assembly is then slid into the spine opening and the fastener heads 29 and 33 are slidably received within the wider portion 22 of slot 21 and the end of the shanks 28 and 35 received in the narrow slot 24 along the interior surface of the bottom wall 19 with the shank 35 of the first two-piece fastener member 31 aligned with the hole 25 in the bottom wall. The shank 36 of the second two piece fastener member 32 is then inserted through the hole 25 and into engagement the with the shank 35 of the first member 31 with the head 34 of the second member 32 received in the counterbore 25.

In this manner, the photographs P or other materials are contained within the envelopes 12. The three exposed side edges of the envelopes sealed and the open side edge of the envelopes are concealed and locked within the top, bottom, and back walls of the binder spine. The permanent fastener prevents the assembled envelopes and non-permanent fasteners from sliding in the slots. The head of the permanent fastener is recessed in the spine counterbore. Thus once assembled, the binder assembly is substantially tamper-proof.

After the client has returned the binder assembly, the authorized photographer or studio may disassemble the binder by inserting the jaws of a wire cutting tool between the top or bottom envelope 12 and the interior surface of the top 18 or bottom 19 wall of the spine 11 and cutting the appropriate shank of the permanent fastener. The assembled envelopes and fasteners can then be easily slid longitudinally out of the slots. The fasteners are pulled from the holes and the contents of the envelopes may be removed for further processing. The spine and non-permanent fasteners can be reused indefinitely, and a single permanent fastener is the only part requiring replacement.

It should be understood that the binder decribed herein may also be used as a conventional binder by substituting a conventional two-piece releasable fastener for the two-piece permanent fastener, wherein one element of the releasable fastener would be releasably engaged with the mating element through the hole in the bottom wall of the spine.

While this invention has been described fully and completely with special emphasis upon a preferred embodiment, it should be understood that within the scope of the appended claims the invention may be practiced otherwise than as specifically described herein.

I claim:

1. A tamper-proof binder for securing together a plurality of sheets having apertures along one side thereof comprising;

a longitudinal generally rectangular spine member having a back wall, a longitudinal open side opposite the back wall, a top wall having a plurality of first fastener elements extending from the underside thereof, a bottom wall having a plurality of second fastener elements extending from the topside thereof in axial alignment with said first fastener elements, and one of said axially aligned pairs of said fastener elements having opposed shank portions adapted to be inserted through aligned apertures in a stack of sheets which have apertures along one side edge, said opposed shank portions having cooperative gripping surfaces thereon which will engage one another in a substantially permanent relation when pressed together axially to provide a very high resistance to disassembly once pressed together.

2. A tamper-proof binder according to claim 1 in which;

said spine member is an open ended longitudinal generally rectangular spine member of generally C-shaped transverse cross section, said top wall having a longitudinally extending fastener receiving upper recess in the underside thereof, and said bottom wall having a longitudinally extending fastener receiving lower recess in the topside thereof, and an opening extending through said bottom wall and said lower recess intermediate the ends thereof, said one pair of fastener elements having a locking fastener installed in said bottom wall opening and having a shank portion to be substantially permanently engaged with the shank of said removable fastener member to prevent relative sliding movement between said fastener members and said spine after being installed whereby the apertured sheets and said fasteners may not be removed, and the other of said first fastener elements is a removable fastener member having a shank portion adapted at one end to be received in said upper recess and the opposite end thereof adapted to be received in said lower recess, said removable fastener member being slidably received longitudinally within said upper and lower recesses from either open end of said spine and said shank portions extending through the sheet apertures and between said spine top and bottom walls.

3. A tamper-proof binder according to claim 2 in which;

each said removable fastener comprises a fastener element having a shank portion and a radially enlarged head at one end thereof, the longitudinally extending upper recess in the underside of said spine top wall comprises a longitudinal slotted cavity extending along the interior surface of said spine top wall to slidably receive the enlarged head portion of at least two fastener members from either open end of said spine, and the longitudinally extending lower recess in the topside of said spine bottom wall comprises a longitudinal slot recessed in the interior surface of said bottom wall in opposed axial alignment with the slotted cavity in said top wall to slidably receive the bottom portions of same said fastener members.

4. A tamper-proof binder according to claim 2 in which;

said locking fastener comprises at least one two-piece fastener each piece having an axially elongated shank portion and a radially enlarged head at one end thereof and the shank portions of each piece adapted to engage the other in a substantially permanent relation when pressed together axially to provide a very high resistance to disassembly once pressed together, and the shank of a first piece of said two-piece fastener being inserted through aligned apertures in a stack of said sheets and the radially enlarged head thereof slidably received within the upper recess of said spine top wall when said removable fastener is slidably received within said spine upper and lower recesses, and the shank of a second piece of said two-piece fastener to be inserted through said hole through said bottom wall and through aligned apertures in said stack of sheets to engage the shaft of said first piece in a substantially permanent relation with the enlarged head portion of said second piece residing within opening in said spine bottom wall to prevent disengagement therefrom and to prevent relative sliding movement between said fasteners and said spine after being engaged whereby the apertured sheets may not be removed.

5. A tamper-proof binder according to claim 2 in which;

said removable fastener member comprises one or more removable fastener members each having a shank portion and a radially enlarged head at one end thereof, said locking means comprises at least one two-piece fastener each piece of which has an axially elongated shank portion and a radially enlarged head at one end thereof and the shank portions of each piece adapted to engage the other in a substantially permanent relation when pressed together axially to provide a very high resistance to disassembly once pressed together, the longitudinally extending upper recess in the underside of said spine top wall comprises a longitudinal slotted cavity extending along the interior surface of said spine top wall to slidably receive the enlarged head portion of at least one said removable fastener and the enlarged head portion of a first piece of said two-piece fastener from either open end of said spine, and the longitudinally extending lower recess in the topside of said spine bottom wall comprises a longitudinal slot recessed in the interior surface of said bottom wall in opposed axial alignment with the slotted cavity in said top wall to slidably receive the bottom portion of said removable fastener, and the shank of a second piece of said two-piece fastener to be inserted through said hole through said bottom wall and through aligned apertures in said stack of sheets to engage the shaft of said first piece in a substantially permanent relation with the enlarged head portion of said second piece residing within the opening in said spine bottom wall to prevent disengagement therefrom and to prevent relative sliding movement between said removable and two-piece fasteners and said spine after engagement of said two-piece fastener whereby the apertured sheets and said removable and two-piece fasteners may not be removed.

6. A tamper-proof binder according to claim 5 in which;

said two-piece fastener comprises a first piece and a second piece each having having an enlarged head portion and an elongated vertically slotted shank with a plurality of vertically spaced protuberences along each shank configured to engage with one another such that when the fastener pieces are pressed together axially they become substantially permanently locked in the assembled state.

7. A tamper-proof binder according to claim 5 in which;

said opening in said spine bottom wall is a hole extending through said bottom wall to receive the shaft of said second piece of said two-piece fastener and having a counterbore extending from the bottom surface of said bottom wall to receive the head of said second piece.

8. A tamper-proof binder according to claim 2 in which;

said longitudinally extending fastener receiving upper recess in the underside of said spine top wall comprises a longitudinal slotted cavity extending along the underside surface of said spine top wall to slidably receive the enlarged head portion of at least two fastener members from either open end of said spine.

9. A tamper-proof binder according to claim 8 in which;

said longitudinally slotted cavity extending along the underside surface of said spine top wall has a generally T-shaped transverse cross section with the narrower portion of the T-shape extending through the interior surface of the top wall to form opposed longitudinal flanges with the wider portion of the T-shape slidably receiving the head portion of the fasteners and the longitudinal flanges slidably receiving the shank of said fasteners.

10. A tamper-proof binder according to claim 2 including;

a plurality of sheets each having a top and bottom ply of material sealed together along three adjacent side edges and unsealed along one side edge with a plurality of apertures through both plies along the open side edge to form an envelope to receive photographs and the like, and said removable fastener shank portion is inserted through aligned apertures in a stack of said sheets whereby when said fastener means is slidably received within said spine upper and lower recesses and said locking means is installed the apertured open side edges of said sheets are captured between said spine top and bottom walls and the remaining portion of said sheets extend through said spine longitudinal open side opposite the back wall to prevent unauthorized access to the contents of the envelopes.

11. A tamper-proof binder according to claim 10 in which;

said plies forming said envelopes are formed of transparent plastic material.

12. A tamper-proof binder according to claim 11 including;

opaque label means on the top sheet forming said envelopes disposed at a location which would partially obscure a small portion of the sheet contents to discourage copying of the contents through the transparent envelope.

13. A tamper-proof binder according to claim 10 in which;

said stack of sheets include a cover sheet comprising a single sheet of opaque material on top of said stack having apertures spaced along one side edge in axial alignment with the apertures in said stack of sheets.

14. A tamper-proof binder according to claim 1 in which;

said stack of sheets include a back sheet comprising a single sheet of opaque material on the bottom of said stack having apertures spaced along one side edge in axial alignment with the apertures in said stack of sheets.

15. A tamper-proof binder according to claim 1 including;

a plurality of sheets each having a top and bottom ply of material sealed together along three adjacent side edges and unsealed along one side edge with a plurality of apertures through both plies along the open side edge to form an envelope to receive photographs and the like, said first and second fastener element shank portions received through aligned apertures in a stack of said sheets and upon said at least one axially aligned pair of said first and second fastener elements being engaged in the substantially permanent relation, said sheets are captured between said spine top and bottom walls and the remaining portion of said sheets extend through said spine longitudinal open side opposite the back wall to prevent unauthorized access to the contents of the envelopes.

16. A tamper-proof binder according to claim 1 including an envelope comprising a top and bottom ply of material sealed together along three adjacent side edges and unsealed along one side edge with a plurality of apertures through both plies along the open side edge to form an envelope to receive photographs and the like.

17. A tamper-proof binder according to claim 16 in which;

said plies of material forming said envelope are formed of transparent plastic material.

18. A tamper-proof binder according to claim 16 including;

opaque label means on the top ply forming said envelopes disposed at a location which would partially obscure a small portion of the envelope contents to discourage copying of the contents through the transparent envelope.

19. A tamper-proof binder assembly for containing photographs and the like comprising;

a longitudinal generally rectangular spine member having a back wall, a longitudinal open side opposite the back wall, a top wall having a plurality of first fastener elements extending from the underside thereof, a bottom wall having a plurality of second fastener elements extending from the topside thereof in axial alignment with said first fastener elements, at least one axially aligned pair of said first and second fastener elements having opposed shank portions adapted to be inserted through aligned apertures in a stack of sheets which have apertures along one side edge and said opposed shank portions having cooperative gripping surfaces thereon which will engage one another in a substantially permanent relation when pressed together axially to provide a very high resistance to disassembly once pressed together, and a plurality of sheets each having a top and bottom ply of material sealed together along three adjacent side edges and unsealed along one side edge with a plurality of apertures through both plies along the open side edge to form an envelope to receive photographs and the like, said first and second fastener element shank portions received through aligned apertures in a stack of said sheets and upon said at least one axially aligned pair of said first and second fastener elements being engaged in the substantially permanent relation, said sheets are captured between said spine top and bottom walls and the remaining portion of said sheets extend through said spine longitudinal open side opposite the back wall to prevent unauthorized access to the contents of the envelopes.

* * * * *